US010598174B2

(12) United States Patent
Ohkubo et al.

(10) Patent No.: US 10,598,174 B2
(45) Date of Patent: Mar. 24, 2020

(54) AIR COMPRESSOR

(71) Applicant: MAX CO., LTD., Tokyo (JP)

(72) Inventors: Shinichi Ohkubo, Tokyo (JP); Tsutomu Yoshida, Tokyo (JP); Haruaki Akasaka, Tokyo (JP)

(73) Assignee: MAX CO., LTD., Tokyo (JP)

( * ) Notice: Subject to any disclaimer, the term of this patent is extended or adjusted under 35 U.S.C. 154(b) by 185 days.

(21) Appl. No.: 15/229,237

(22) Filed: Aug. 5, 2016

(65) Prior Publication Data

US 2017/0037842 A1 Feb. 9, 2017

(30) Foreign Application Priority Data

Aug. 7, 2015 (JP) ..... 2015-156542

(51) Int. Cl.

| | |
|---|---|
| ***F04B 49/02*** | (2006.01) |
| ***F04B 35/04*** | (2006.01) |
| ***F04B 41/02*** | (2006.01) |
| ***F04B 49/06*** | (2006.01) |

(52) U.S. Cl.

CPC ..... *F04B 49/022* (2013.01); *F04B 35/04* (2013.01); *F04B 41/02* (2013.01); *F04B 49/065* (2013.01); *F04B 2205/063* (2013.01)

(58) Field of Classification Search

CPC ..... F04B 49/022; F04B 49/065; F04B 2205/063; F04B 41/02

See application file for complete search history.

(56) References Cited

U.S. PATENT DOCUMENTS

| | | | | |
|---|---|---|---|---|
| 8,021,122 | B2 * | 9/2011 | Clayton | H01Q 1/081 343/915 |
| 8,641,967 | B2 * | 2/2014 | Bik | D06F 35/008 210/764 |
| 9,689,106 | B2 * | 6/2017 | Morham | D06F 39/022 |
| 9,705,309 | B2 * | 7/2017 | Peng | H02H 5/083 |
| 2003/0099549 | A1 | 5/2003 | Shen | |
| 2004/0191073 | A1 | 9/2004 | Iimura et al. | |

(Continued)

FOREIGN PATENT DOCUMENTS

| | | |
|---|---|---|
| CN | 1534194 A | 10/2004 |
| JP | A-H06-185468 | 7/1994 |

(Continued)

OTHER PUBLICATIONS

Extended European Search Report dated Jan. 4, 2017 in corresponding European patent application 16001735.6 (8 pages).

*Primary Examiner* — Christopher S Bobish

(74) *Attorney, Agent, or Firm* — Faegre Drinker Biddle & Reath LLP

(57) ABSTRACT

An air compressor includes a tank unit that stores compressed air, a motor unit that generates compressed air to be stored in the tank unit, a pressure detection unit that detects a pressure value in the tank unit, and a control unit that drives the motor unit when a pressure value in the tank unit detected by the pressure detection unit is equal to or less than a motor start pressure value, and stops the motor unit when the pressure value in the tank unit detected by the pressure detection unit is equal to or greater than a motor stop pressure value. The control unit changes at least either of the motor start pressure value or the motor stop pressure value every time when a predetermined time passed.

7 Claims, 9 Drawing Sheets

(56) References Cited

U.S. PATENT DOCUMENTS

| | | | |
|---|---|---|---|
| 2006/0110258 | A1 | 5/2006 | Iimura et al. |
| 2009/0288849 | A1 | 11/2009 | Iimura et al. |
| 2011/0206538 | A1 | 8/2011 | Yokota et al. |
| 2014/0186193 | A1 | 7/2014 | Yokota et al. |

FOREIGN PATENT DOCUMENTS

| | | | |
|---|---|---|---|
| JP | A-2004/036487 | | 2/2005 |
| JP | 2009-055719 | A | 3/2009 |
| JP | 2010-090824 | A | 4/2010 |
| JP | 2011-214473 | A | 10/2011 |
| WO | WO-A1-2013-042318 | | 3/2013 |

* cited by examiner

AIR COMPRESSOR

CROSS-REFERENCE TO RELATED APPLICATION

This application claims priorities from Japanese Patent Application No. 2015-156542 filed on Aug. 7, 2015, the entire contents of which are incorporated herein by reference.

FIELD

The present invention relates to an air compressor, and more particularly, to an air compressor that performs control to drive a motor unit when a pressure value in a tank unit is equal to or less than a motor start pressure value, and to stop the motor unit when the pressure value in the tank unit is equal to or more than a motor stop pressure value.

BACKGROUND

An air compressor is widely being used in a construction site to supply compressed air to a driving tool, such as a nail driving machine, using compressed air. The air compressor generates compressed air in a compressed air generating unit by driving a motor unit, and stores the generated compressed air in a tank unit. The stored compressed air of high pressure is reduced to predetermined pressure by a pressure reducing valve and then is supplied to the driving tool (for example, see Patent Document 1).

A user may set the pressure of the air compressor to a state suitable for a work condition, by setting the use mode of the air compressor depending on the use condition of the driving tool or the like. For example, the air compressor has four use modes, that is, a low pressure mode, a normal pressure mode, a high pressure mode, and a ultra-high pressure mode, depending on a pressure state in the tank unit. Further, since there is a combination of three modes, namely, a normal operation mode, a power mode (quick charge mode), and a silent mode for each use mode, it is possible to set a mode of a plurality of patterns in total.

Patent Document 1: Japanese Patent Publication No. 2009-55719

However, it is not easy for a user to properly determine and select the mode setting of the plurality of patterns, depending on an operating condition. Further, an operation of changing the mode setting of the air compressor depending on the work condition causes inconvenience to many users. Hence, in order to supply a sufficient amount of compressed air to the driving tool under any work condition, the use mode is often set to a higher mode, such as the high pressure mode or the ultra-high pressure mode that keeps the pressure in the tank unit high.

As such, when the use mode of the air compressor is set to the higher mode, the pressure in the tank unit is set to a high value. The higher the pressure is, the less compression efficiency is. Thus, until the air compressor starts and then the pressure value in the tank unit reaches a motor stop pressure value, a relatively long time may be required, a driving sound caused by the driving of the motor unit may be generated for a relatively long time, and driving power may be increased. Further, since the pressure in the tank unit is kept high, high pressure load may be applied to the motor unit, the tank unit, the compressor (compressed air generating unit) and the like, and components may be worn out. Consequently, this leads to a reduction in durability.

Meanwhile, when the use mode of the air compressor is set to a lower mode such as the low pressure mode or the normal pressure mode, when pressure in the tank unit is lowered by using the driving tool, the compressed air for adequately driving the driving tool becomes rapidly insufficient, and work using the driving tool should be ceased until the pressure in the tank unit rises.

SUMMARY

The invention is made in view of the above problems, and is to provide an air compressor, which is capable of properly changing a pressure state in a tank unit, depending on a use condition of a driving tool.

In order to accomplish the object, the invention provides an air compressor comprising:

a tank unit that stores compressed air;

a motor unit that generates compressed air to be stored in the tank unit;

a pressure detection unit that detects a pressure value in the tank unit; and a control unit that drives the motor unit when a pressure value in the tank unit detected by the pressure detection unit is equal to or less than a motor start pressure value, and stops the motor unit when the pressure value in the tank unit detected by the pressure detection unit is equal to or greater than a motor stop pressure value, wherein the control unit changes at least either of the motor start pressure value or the motor stop pressure value every time when a predetermined time passed.

Further, the air compressor according to the invention includes:

a tank unit that stores compressed air;

a motor unit that generates compressed air to be stored in the tank unit;

a pressure detection unit that detects a pressure value in the tank unit; and a control unit that drives the motor unit when a pressure value in the tank unit detected by the pressure detection unit is equal to or less than a motor start pressure value, and stops the motor unit when the pressure value in the tank unit detected by the pressure detection unit is equal to or greater than a motor stop pressure value, wherein the control unit changes an output of the motor unit every time when a predetermined time passed.

Furthermore, the air compressor according to the invention includes:

a tank unit that stores compressed air;

a motor unit that generates compressed air to be stored in the tank unit;

a pressure detection unit that detects a pressure value in the tank unit; and a control unit that drives the motor unit when a pressure value in the tank unit detected by the pressure detection unit is equal to or less than a motor start pressure value, and stops the motor unit when the pressure value in the tank unit detected by the pressure detection unit is equal to or greater than a motor stop pressure value, when a pressure value in the tank unit detected by the pressure detection unit is equal to or less than a driving pressure value required to drive a driving unit connected to the air compressor, the control unit increases at least either of the motor start pressure value or the motor stop pressure value every time when a predetermined time passed.

Further, the air compressor according to the invention includes:

a tank unit that stores compressed air;

a motor unit that generates compressed air to be stored in the tank unit;

a pressure detection unit that detects a pressure value in the tank unit; and a control unit that drives the motor unit when a pressure value in the tank unit detected by the pressure detection unit is equal to or less than a motor start pressure value, and stops the motor unit when the pressure value in the tank unit detected by the pressure detection unit is equal to or greater than a motor stop pressure value, wherein when a pressure value in the tank unit detected by the pressure detection unit is equal to or less than a driving pressure value required to drive a driving unit connected to the air compressor, the control unit changes an output of the motor unit every time when a predetermined time passed.

In the above-described air compressor, the control unit may reduce at least either of the motor start pressure value or the motor stop pressure value every time when a predetermined time passed in the state where the motor unit is stopped.

In the above-described air compressor, the control unit may change the motor stop pressure value, when a variation of the pressure value in the tank unit detected by the pressure detection unit is smaller than a predetermined variation.

The air compressor according to the invention sets to change at least either of the motor start pressure value or the motor stop pressure value every time when a predetermined time passed. For example, when at least either of the motor start pressure value or the motor stop pressure value is reduced every time when a predetermined time has passed, little compressed air is used, thus preventing the pressure in the tank unit from being kept high. Since it is possible to reduce a driving amount and a driving time in the motor unit, current consumption caused by the driving of the motor unit may be reduced. Since it is possible to reduce a driving amount and a driving time in the motor unit, current consumption caused by the driving of the motor unit may be reduced. Further, since a side having a low compressive load may make sound quieter, it is possible to provide a low noise. Since it is possible to drop a pressure in the tank unit, a load applied to the motor unit or the tank unit may be reduced, in addition to improving durability.

DETAILED DESCRIPTION

Hereinafter, an example of an air compressor according to the invention will be illustrated and described in detail with reference to the accompanying drawings.

Figure 1:
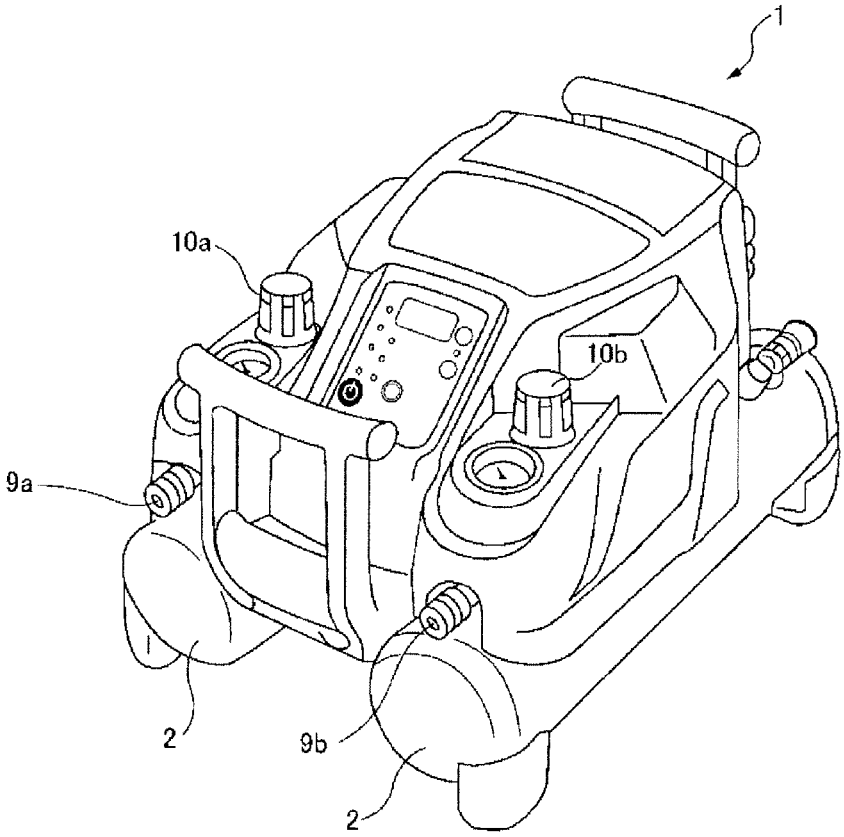
FIG. 1 is an external perspective view illustrating an air compressor according to an embodiment.
Figure 2:
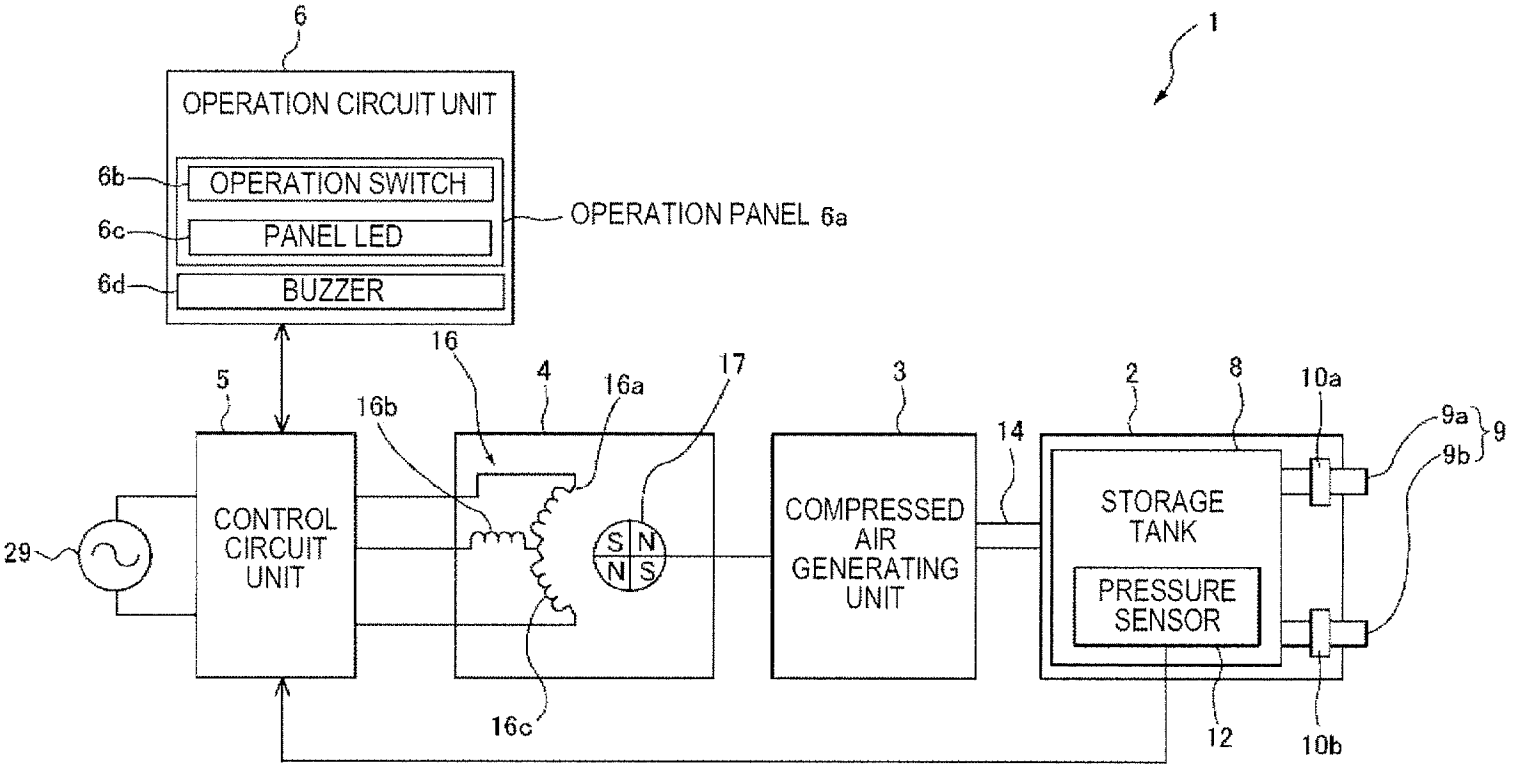
FIG. 2 is a block diagram illustrating a schematic configuration of the air compressor according to the embodiment.

FIG. 1 is an external perspective view illustrating an air compressor according to an embodiment, and FIG. 2 is a block diagram illustrating a schematic configuration of the air compressor. The air compressor 1 mainly includes a tank unit 2, a compressed air generating unit 3, a motor unit (motor) 4, a control circuit unit (control unit) 5, and an operation circuit unit 6.

The tank unit 2 has a storage tank 8 to store compressed air. The compressed air of a predetermined pressure generated by the compressed air generating unit 3 is stored in the storage tank 8. The air compressor 1 according to this embodiment is characterized in that the pressure of the storage tank 8 is changed depending on the use condition of a driving tool (driving unit; not shown), such as a nail driving machine. A storage tank of a general air compressor is usually kept at a pressure of about 3.9 MPa to 4.4 MPa, while the storage tank 8 of the air compressor 1 according to this embodiment is changed in pressure to about 2.5 MPa to 4.0 MPa by setting an AI (Artificial Intelligence) mode that will be described below.

A plurality of compressed-air outlet ports 9 is formed in the storage tank 8. According to this embodiment, a high-pressure outlet port 9*a* for discharging compressed air of high pressure and a normal-pressure outlet port 9*b* for discharging compressed air of normal pressure are formed. Pressure reducing valves 10*a* and 10*b* are formed in the outlet ports 9*a* and 9*b*, respectively, to reduce the compressed air, which may be obtained from the outlet ports 9*a* and 9*b*, respectively, to desired pressure.

As described above, since the compressed air in the storage tank 8 is usually kept at the pressure of 3.9 MPa to 4.4 MPa, both the compressed air discharged from the high-pressure outlet port 9*a* and the compressed air discharged from the normal pressure outlet port 9*b* may be kept at the desired pressure by the pressure reducing valves 10*a* and 10*b*. Further, in order to supply the compressed air, which is reduced in pressure by the pressure reducing valves 10*a* and 10*b*, to the driving tool, an air hose (not shown) may be detachably attached to each of the outlet ports 9*a* and 9*b*.

A pressure sensor (pressure detection unit) 12 is provided in the storage tank 8 to detect the pressure in the storage tank 8. The pressure sensor 12 functions to convert a change in pressure in the storage tank 8 into an electrical signal by a pressure sensitive element, and the detected electrical signal is outputted to the control circuit unit 5.

The compressed air generating unit 3 has a structure that generates a compressed air by causing a piston provided in the cylinder to reciprocate and by compressing the air drawn from an intake valve of the cylinder into the cylinder. The compressed air is supplied to the storage tank 8 of the tank unit 2 via a connecting pipe 14.

The motor unit 4 serves to generate a driving force for causing the piston of the compressed air generating unit 3 to reciprocate. The motor unit 4 is provided with a stator 16 and a rotor 17 for generating the driving force. The stator 16 is formed with a U-phase winding 16*a*, a V-phase winding 16*b*, and a W-phase winding 16*c*, and the rotating magnetic field is formed by making a current flow to the windings 16*a* to 16*c*. The rotor 17 is constituted by the permanent magnet, and the rotation of the rotor 17 is performed by the rotating magnetic field formed by the current flowing through the windings 16*a*, 16*b*, and 16*c* of the stator 16.

The operation circuit unit 6 is a circuit unit that constitutes an operation panel 6*a* through which a user sets an operation mode or like of the air compressor 1. An operation switch 6*b* is provided on the operation panel 6*a* to set the operation mode or the like. The user may set and change the operation mode or the like by operating the operation switch 6*b*.

In the air compressor 1 according to this embodiment, it is possible to select an AI mode, a power mode, and a silent mode as the operation mode. Here, the AI mode is an operation mode that changes a pressure value in the tank unit 2 depending on the use condition (use condition of the compressed air) of the driving tool.

More specifically, the air compressor 1 is generally configured to stop driving the motor unit 4 when the pressure value in the tank unit 2 is equal to or more than a stop pressure value (Hereinafter, the stop pressure value is referred to as an OFF pressure value. This corresponds to a motor stop pressure value of the invention.), and configured to start to drive the motor unit 4 when the pressure value in the tank unit 2 is equal to or less than a restart pressure value (Hereinafter, the restart pressure value is referred to as an ON pressure value. This corresponds to a motor start pressure value of the invention.). When the operation mode is set to the AI mode, the air compressor 1 performs control to change the ON pressure value prescribing the start of the motor unit 4 and the OFF pressure value prescribing the stop, depending on the driving situation of the motor unit 4.

The operation panel 6*a* has a panel LED 6*c* to allow a pressure state of the compressed air in the tank unit 2 to be displayed. The panel LED 6*c* displays an error when it occurs, and informs a user of the occurrence of the error. A buzzer 6*d* is provided on the operation circuit unit 6 to generate alarm sound when the error occurs.

Operation information, such as an operation mode, set by the operation circuit unit 6 is outputted to the control circuit unit 5. The operation circuit unit 6 receives information (information on pressure value in tank unit) on the compressed air in the tank unit 2 from the control circuit unit 5, and receives error information when an error occurs. When the information on the compressed air and the error information are received from the control circuit unit 5, the operation circuit unit 6 displays the received information on the panel LED 6*c*. When necessary, the operation circuit unit 6 emits the alarm sound by the buzzer 6*d*.

Figure 3:
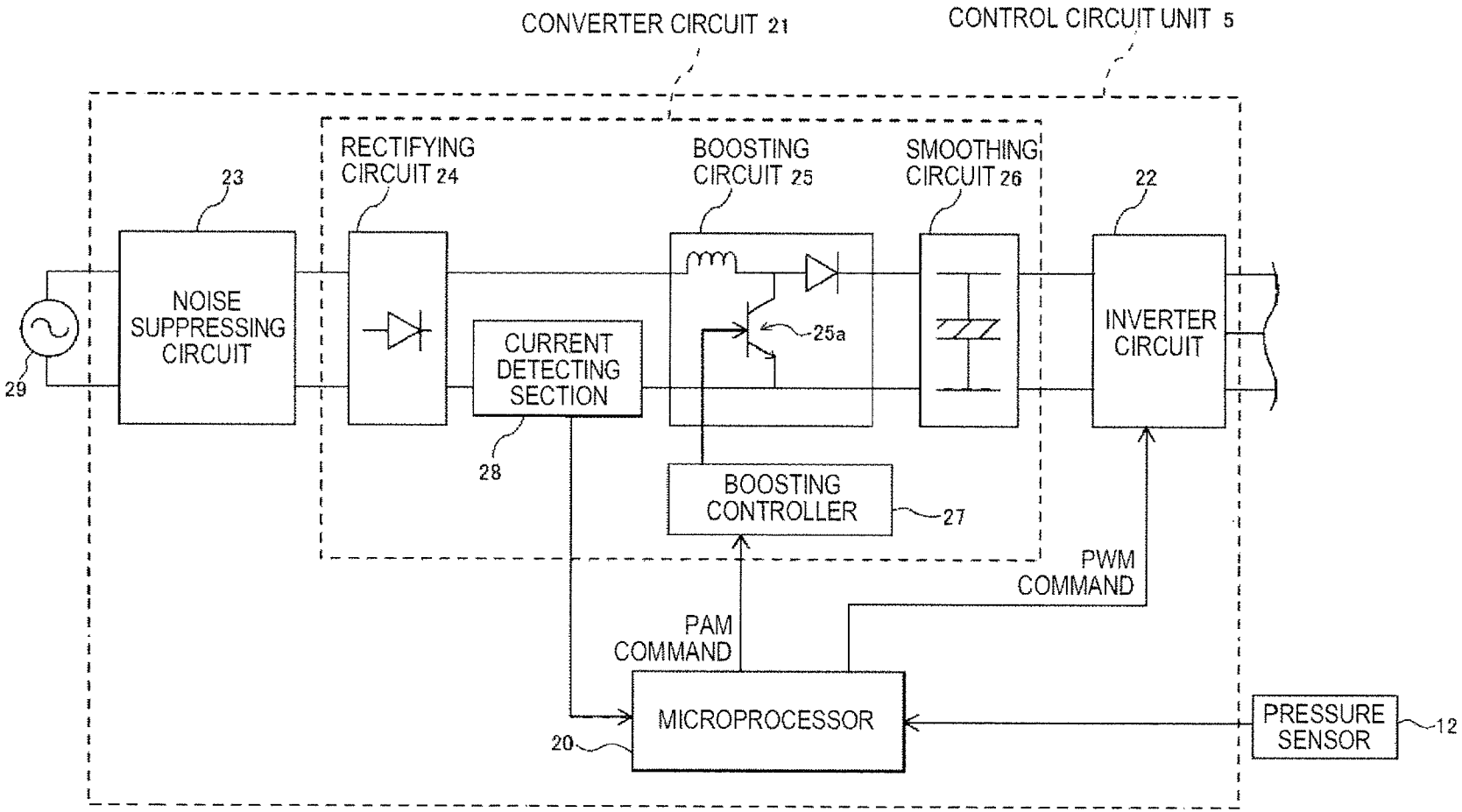
FIG. 3 is a block diagram illustrating a schematic configuration of a control circuit unit according to the embodiment.

As illustrated in FIG. 3, the control circuit unit 5 mainly includes a microprocessor (MPU: Micro Processing Unit, control unit) 20, a converter circuit 21, an inverter circuit 22, and a noise suppressing circuit 23.

The noise suppressing circuit 23 is a circuit for suppressing noise of an input current (AC current) from an AC power supply 29 that becomes a driving source of the air compressor 1, and serves as a noise filter. The noise suppressing circuit 23 removes noise overlapping the input current (AC current) from the AC power supply 29, and then outputs the input current (AC current) to the converter circuit 21.

The converter circuit 21 mainly includes a rectifying circuit 24, a boosting circuit 25, and a smoothing circuit 26. The converter circuit 21 performs a so-called PAM (Pulse Amplitude Modulation) control. In this regard, the PAM control is a method that controls the number of revolutions of the motor unit 4 by changing pulse amplitude of output voltage by the converter circuit 21. Meanwhile, the inverter circuit 22 performs a so-called PWM (Pulse Width Modulation) control. The PWM control is a method that controls the number of revolutions of the motor unit 4 by changing a pulse width of output voltage.

The PAM control is a control method that is principally used in a high output or steady-state operation, because it is less in reduction of efficiency during low speed rotation in the motor unit 4 than the PWM control and copes with high speed rotation by raising voltage. On the other hand, the PWM control is a control method that is principally used in a starting operation or when voltage drops. The microprocessor 20 performs control by very appropriately switching between the PAM control by the converter circuit 21 and the PWM control by the inverter circuit 22, depending on the operating condition of the air compressor 1.

The rectifying circuit 24 and the smoothing circuit 26 of the converter circuit 21 serve to rectify and smooth AC current performing the reduction (suppression) of noise by the noise suppressing circuit 23, thus converting the AC current into DC voltage. A switching element 25*a* is formed in the boosting circuit 25, and serves to perform the amplitude control of the DC voltage, in response to a control instruction of the microprocessor 20. The boosting circuit 25 is controlled through a boosting controller 27 that receives a PAM instruction from the microprocessor 20.

Further, a current detecting section 28 is formed between the rectifying circuit 24 and the boosting circuit 25 of the converter circuit 21. A current value detected by the current detecting section 28 is outputted to the microprocessor 20.

The inverter circuit 22 serves to convert the DC voltage into the AC voltage having a pseudo sine wave, by converting the pulse of the DC voltage converted by the converter circuit 21 to a positive or negative value at a predetermined period and simultaneously converting a pulse width. By regulating this pulse width, it is possible to control the drive current quantity (control current value, control current) as well as the number of revolutions of the motor unit 4, as described above. As an output value for the inverter circuit 22 is regulated, the microprocessor 20 controls the driving amount of the motor unit 4.

The microprocessor 20 is a control unit that causes the pressure of the compressed air of the tank unit 2 to be stabilized to 2.5 MPa to 4.0 MPa, by performing the driving control of the converter circuit 21 and the inverter circuit 22. The microprocessor 20 includes an operation processing unit (CPU: Central Processing Unit), an RAM (Random Access Memory) used as a temporary storage area such as a work memory, and an ROM (Read Only Memory) in which a control process program (for example, processing programs illustrated in FIGS. 4A to 7, initial values of ON pressure values and OFF pressure values of respective operation modes (power mode, AI mode, and silent mode), and a control current value) that will be described below is recorded. Further, the microprocessor 20 has a memory (non-volatile memory) that records information about an operation mode shortly before power is cut off, during the power cutoff.

Pressure information (pressure value in tank unit) about the compressed air in the tank unit 2 detected by the pressure sensor 12 and current-value information (information about drive current value) detected by the current detecting section 28 are inputted to the microprocessor 20. Meanwhile, the microprocessor 20 is configured to output the control information (PAM instruction, PWM instruction) to the converter circuit 21 and the inverter circuit 22. The converter circuit 21 and the inverter circuit 22 execute the driving control of the motor unit 4, based on the control information outputted by the microprocessor 20.

The microprocessor 20 outputs the PAM instruction to the boosting controller 27, thus controlling the switching element 25*a* of the boosting circuit 25 through the boosting controller 27, and performing the driving control of the converter circuit 21. Likewise, the microprocessor 20 outputs the PWM instruction to the inverter circuit 22, thus controlling the inverter circuit 22.

In the case of performing the PAM control or the PWM control, the microprocessor 20 determines the operation amount of the converter circuit 21 and the inverter circuit 22 and performs the driving control of the motor unit 4 to reach a targeted drive current value and a targeted pressure value in the tank unit 2, based on the drive current value detected by the current detecting section 28 and the pressure information detected by the pressure sensor 12.

Figure 4A:
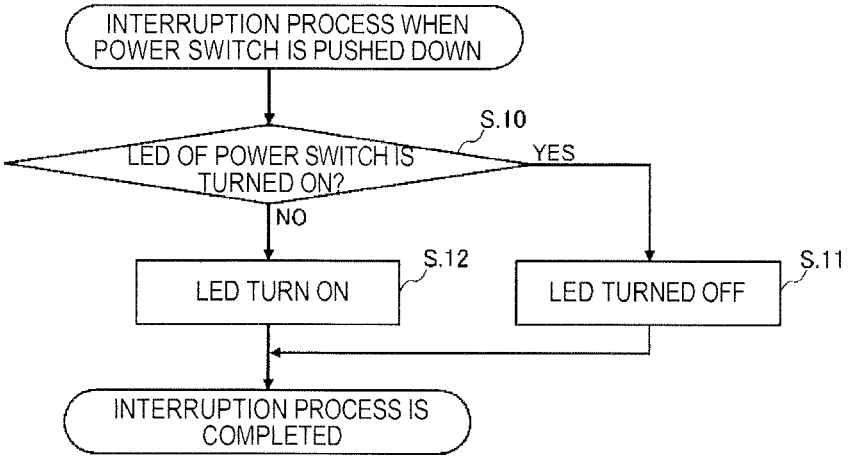
FIG. 4A is a flowchart illustrating processing contents for an interruption process in a microprocessor according to the embodiment.

Next, the processing contents of the microprocessor 20 will be described. FIG. 4A is a flowchart illustrating the processing contents of the microprocessor 20 that is executed when a power switch that is one of an operation switch 6*b* in the operation circuit unit 6 is pushed down by a user. The microprocessor 20 repeatedly determines whether the power switch is pushed down, at regular intervals, immediately after a plug of the air compressor 1 is inserted into a socket. When the pushing down of the power switch is detected through the operation circuit unit 6, the microprocessor 20 executes the interruption process when the power switch pushed down illustrated in FIG. 4A.

The microprocessor 20 determines whether an LED of the power switch in the operation circuit unit 6 is turned on (S.10). To be more specific, when the power switch in the operation circuit unit 6 is operated to supply the power, the LED of the power switch is turned on due to the supplied power. Further, when the power switch is operated to cut off the power in the state where the LED of the power switch is turned on, the LED of the power switch is turned off due to the power cutoff. When the LED of the power switch is thus turned on or off, turning-on and turning-off information (turning-on information and turning-off information) about the LED of the power switch is outputted from the operation circuit unit 6 to the microprocessor 20.

When it is determined that the LED of the power switch is turned on (Yes in S.10), based on the turning-on and turning-off information received from the operation circuit unit 6, the microprocessor 20 records (or changes) in a predetermined area of the RAM the turning-off information as the turning-on and turning-off information in the LED of the power switch (S.11), thus completing the process. In contrast, when it is determined that the LED of the power switch is turned off, based on the turning-on and turning-off information received from the operation circuit unit 6 (No in S.10), the microprocessor 20 records (or changes) in a predetermined area of the RAM the turning-on information as the turning-on and turning-off information in the LED of the power switch (S.12), thus completing the process. The microprocessor 20 reads the turning-on and turning-off information recorded in the RAM if necessary, so that it may determine whether the LED of the power switch is turned on or not (for example, S.102, S.111, S.131 and others that will be described below).

Figure 4B:
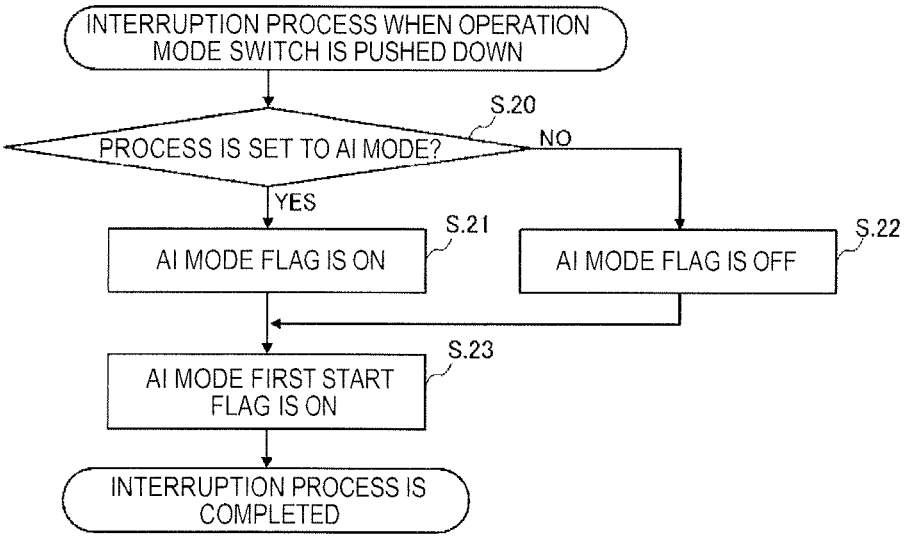
FIG. 4B is a flowchart illustrating processing contents for an interruption process in a microprocessor according to the embodiment.

FIG. 4B is a flowchart illustrating the processing contents of the microprocessor 20 that is executed when an operation mode switch that is one of an operation switch 6*b* in the operation circuit unit 6 is pushed down by a user. The microprocessor 20 repeatedly determines whether the operation mode switch is pushed down, at regular intervals, immediately after the power switch is operated and the air compressor 1 is started. When the pushing down of the operation mode switch is detected through the operation circuit unit 6, the microprocessor 20 executes the interruption process when the operation mode switch is pushed down illustrated in FIG. 4B.

The microprocessor 20 determines whether the AI mode is set or not by pushing down the operation mode switch in the operation circuit unit 6 (S.20). To be more specific, when the operation mode switch in the operation circuit unit 6 is pushed down, it is possible to change the setting of the operation mode in the order of the power mode, the AI mode, and the silent mode every time when the operation mode switch is pushed down. When any operation mode is determined by pushing the operation mode switch down, the information of the set operation mode is transmitted from the operation circuit unit 6 to the microprocessor 20, and is recorded in the RAM as the operation mode information. The microprocessor 20 reads the operation mode information of the RAM, so that it is determined whether the AI mode is set as the operation mode information.

When it is determined that the AI mode is set by the operation mode information recorded in the RAM (Yes in S.20), the microprocessor 20 sets an AI mode flag recorded in the predetermined area of the RAM in an ON state (S.21). In contrast, when it is determined that the AI mode is not set (No in S.20), the microprocessor 20 sets the AI mode flag recorded in the predetermined area of the RAM in an OFF state (S.22). After the AI mode flag was set (S.21 or S.22), the microprocessor 20 sets an AI mode first start flag recorded in the predetermined area of the RAM in an ON state (S.23).

In this regard, the AI mode first start flag is a flag that is set to the ON state (S.23) immediately after the insertion of the air compressor 1 into the socket (S.104 that will be described below) and when the operation mode is set and changed. When the AI mode first start flag is ON (Yes in S.115 that will be described below), in a process (S.116) that will be described below, initial values of the ON pressure value and the OFF pressure value of the motor unit 4 in the AI mode are set, and an initial value of the control current value is set. Thereafter, the microprocessor 20 completes the interruption process when the operation mode switch illustrated is pushed down in FIG. 4B.

Figure 4C:
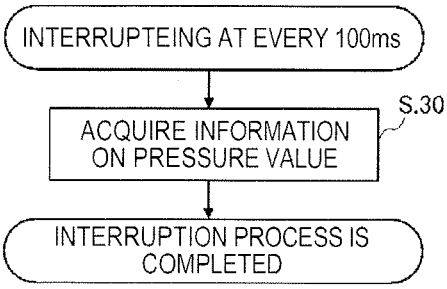
FIG. 4C is a flowchart illustrating processing contents for an interruption process in a microprocessor according to the embodiment.

FIG. 4C is a flowchart illustrating the processing contents in which the microprocessor 20 detects the pressure value in the tank unit 2. The microprocessor 20 executes an interruption process illustrated in FIG. 4C, per 100 ms (100 milliseconds) immediately after the air compressor 1 is started by operating the power switch.

The microprocessor 20 acquires information on the pressure value in the tank unit 2 from the pressure sensor 12, per 100 ms (S.30), and then records the information in the RAM. The microprocessor 20 completes an interruption process illustrated in FIG. 4C.

Figure 5:
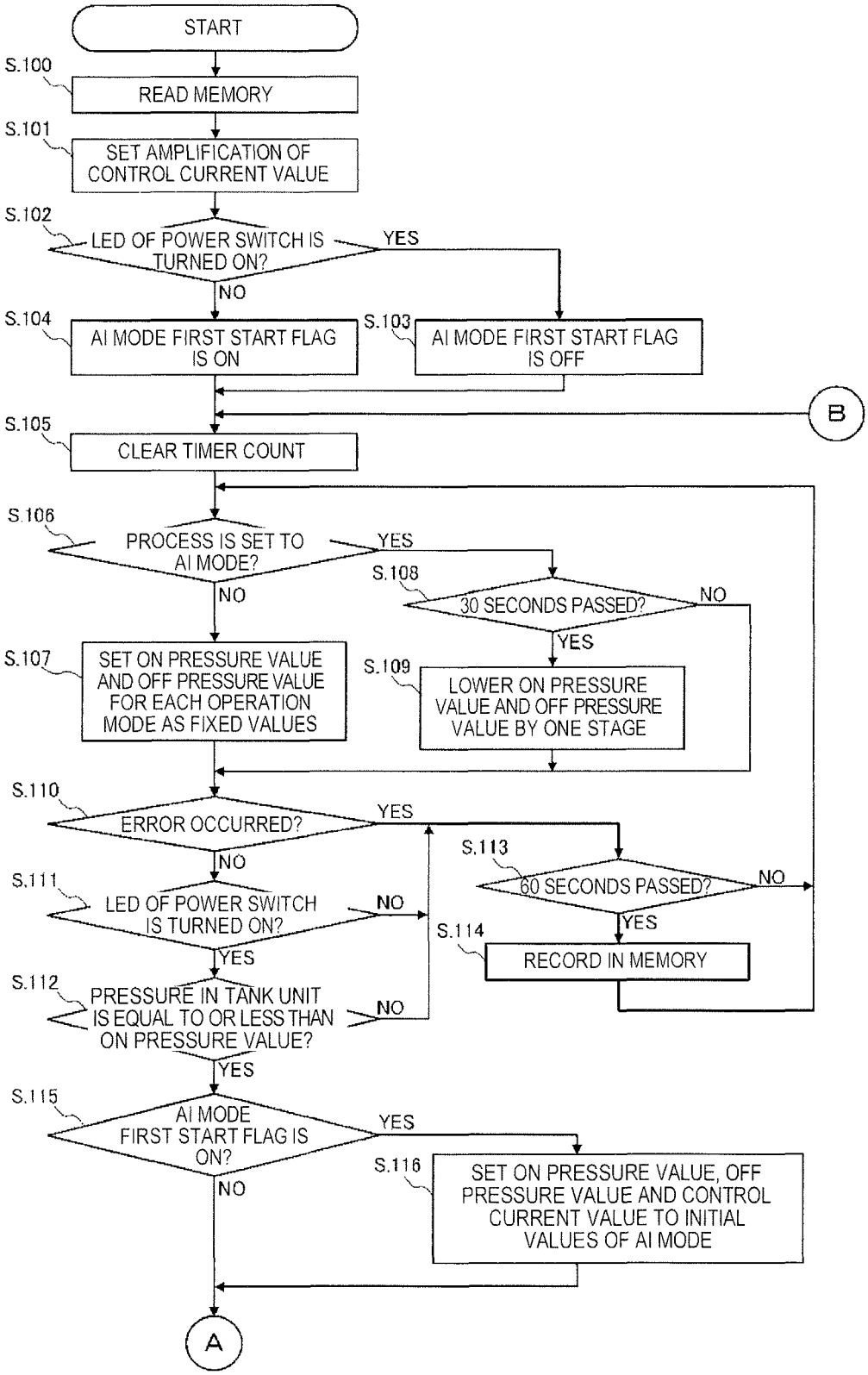
FIG. 5 is a flowchart illustrating a part of a driving control process of a motor unit in the microprocessor according to the embodiment.
Figure 6:
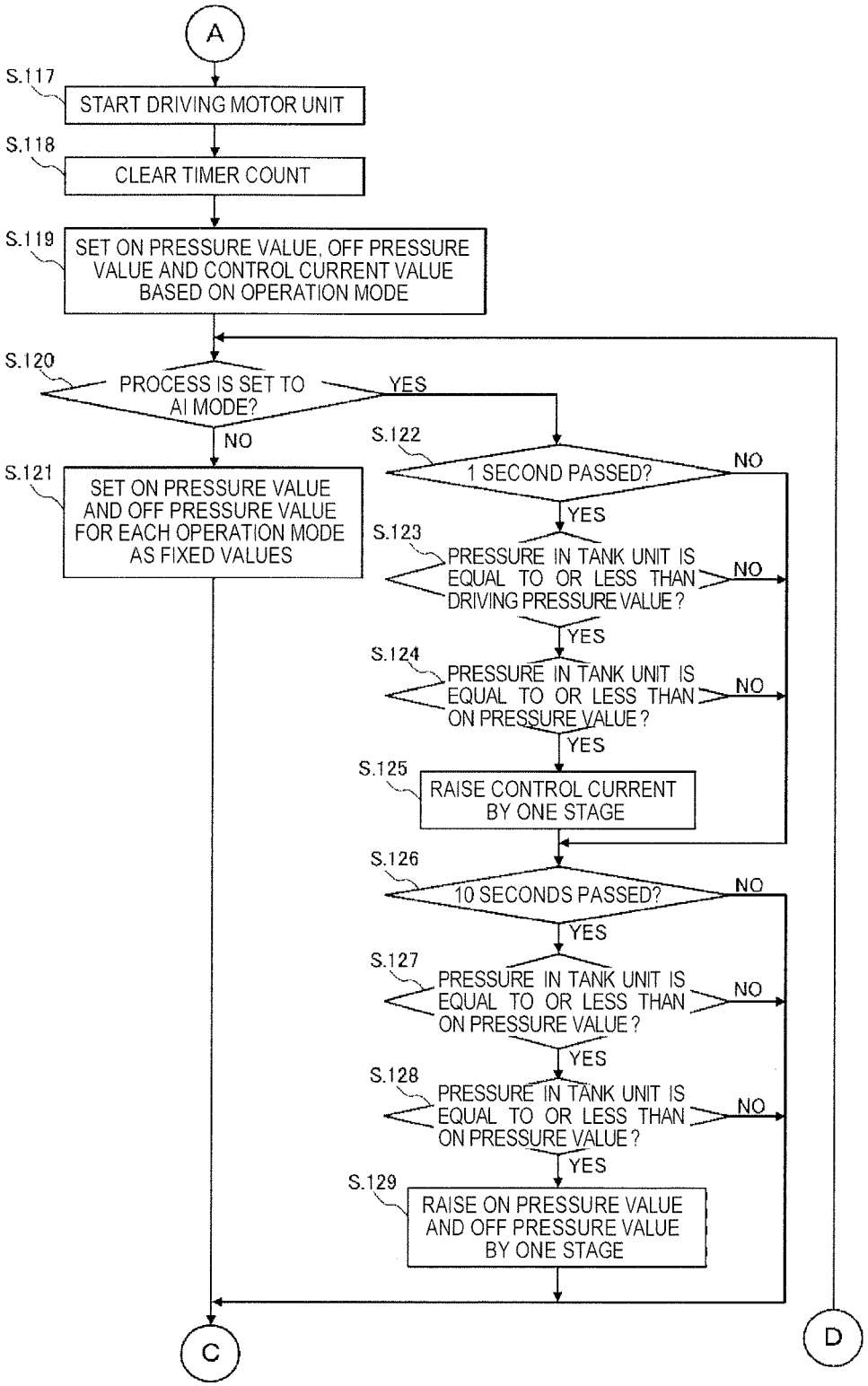
FIG. 6 is a flowchart illustrating a part of the driving control process of the motor unit in the microprocessor according to the embodiment.
Figure 7:
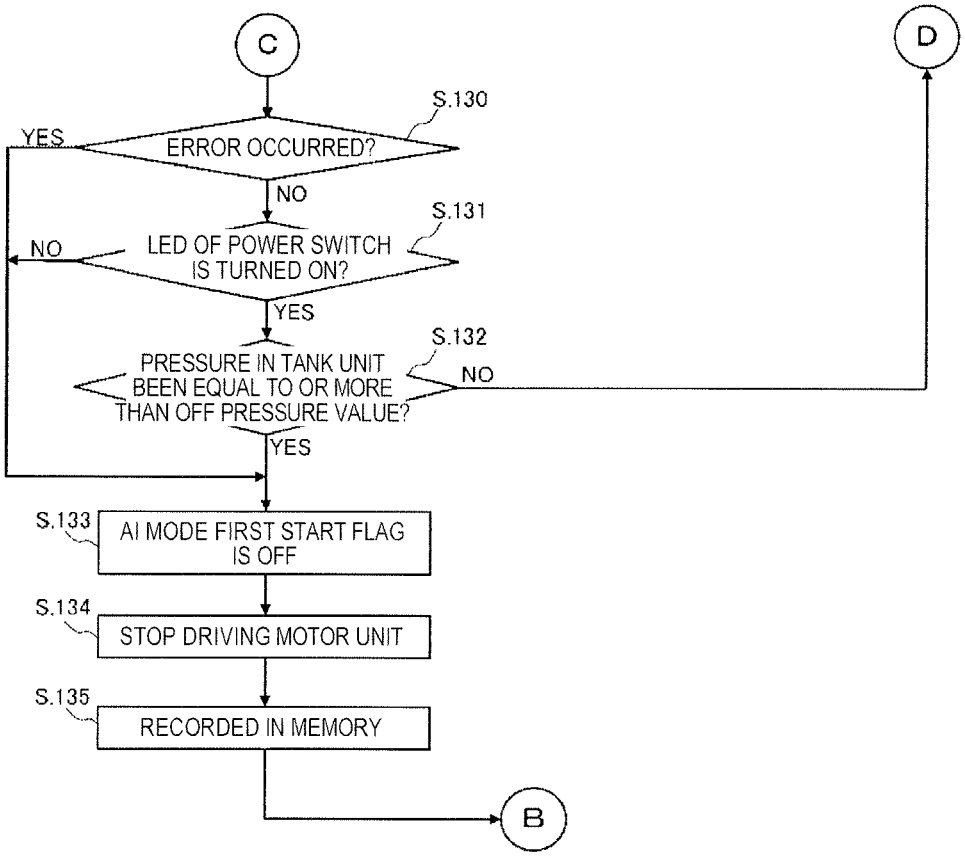
FIG. 7 is a flowchart illustrating a part of the driving control process of the motor unit in the microprocessor according to the embodiment.

FIGS. 5 to 7 are flowcharts illustrating processing contents in which the microprocessor 20 controls the driving of the motor unit 4, in the air compressor 1. In order for the microprocessor 20 to control the motor unit 4, in the air compressor 1, the following three conditions should be satisfied: 1) no error occurs, 2) the LED of the power switch is turned on, 3) the pressure value of the tank unit 2 is equal to or less than the ON pressure value.

1) As for the condition that no error occurs, a power/voltage check interruption process or a component-temperature check interruption process which are separately set are started at predetermined time intervals, and it is determined whether the error is present or not, based on the detected power/voltage or the value of the component temperature. When the error occurs, the information on the error is recorded in the RAM, and the microprocessor 20 performs the error check process (S.110 and S.130 that will be described below).

2) As for the condition that the LED of the power switch is turned on, it may be determined by reading the turning-on and turning-off information recorded in the RAM by the interruption process when the power switch is pushed down as illustrated in FIG. 4A.

3) As for the condition that the pressure value of the tank unit 2 is equal to or less than the ON pressure value, as illustrated in FIG. 4C, the pressure value in the tank unit 2 is detected every 100 ms, so that it may be determined whether the detected pressure value is equal to or less than the ON pressure value, by the microprocessor 20.

Further, 3.0 MPa is recorded in the ROM of the microprocessor 20 as an initial value of the ON pressure value in the AI mode, and 3.4 MPa is recorded in the ROM as an initial value of the OFF pressure value. These initial values of the ON pressure value and the OFF pressure value are read from the ROM by a memory reading process (S.100 that will be described below) that will be described below, are recorded in the RAM, and change the ON pressure value and the OFF pressure value depending on subsequent processes (processes S.109 and S.129 that will be described below).

Further, 13.0 A is recorded in the ROM as an initial value of the control current value employed when the driving of the motor unit 4 is controlled. The control current value represents an upper limit of a drive current value of the air compressor 1 that varies depending on the driving control of the converter circuit 21 and the inverter circuit 22. Since the drive current of the air compressor 1 may be detected by the current detecting section 28, the microprocessor 20 performs the driving control of the converter circuit 21 and the inverter circuit 22 such that the upper limit of the drive current detected by the current detecting section 28 is equal to or less than the control current value. The control current value is also read from the ROM by the memory reading process (S.100 that will be described below) that will be described below, is recorded in the RAM, and is changed depending on subsequent processes (processes S.109 and S.125 that will be described below).

As illustrated in FIG. 5, the microprocessor 20 first performs a memory (non-volatile memory) reading process, as the driving control of the motor unit 4 in the air compressor 1 (S.100). The memory (non-volatile memory) performing the reading process records information about a power failure socket flag that is set when the supply of power to the air compressor 1 is abruptly stopped due to a power failure or the like, information about the operation mode when a stop process is performed by the power switch, and information about a capacity (extension of tank capacity) of the tank unit 2. As described above, the microprocessor 20 simultaneously performs the process of reading the initial values of the OFF pressure value, the ON pressure value and the control current value in the AI mode, which are recorded in the ROM. The information read by the microprocessor 20 is recorded in the RAM.

Next, the microprocessor 20 sets the amplification of the control current value that is increased or decreased when the operation mode is the AI mode, based on the information about the capacity of the tank unit 2 recorded in the RAM (S.101). Generally, when the capacity of the tank unit 2 is large, the amplification value is increased. According to the present embodiment, in the case of a general tank capacity, the current value is increased or reduced by 0.1 A (for example, S.109 and S.125 that will be described below). However, when an auxiliary tank is formed in the tank unit 2, an amplification value is increased 1.5 times. When the auxiliary tank is formed and thus the tank capacity is 27 liters, the amplification value is increased 2.5 times. According to the present embodiment, a case where no auxiliary tank is formed and the tank capacity is not 27 liters, namely, a case where the control current value is increased or reduced by 0.1 A will be described.

The microprocessor 20 determines whether the LED of the power switch is turned on or not (S.102). When the LED of the power switch is turned on (Yes in S.102), the AI mode first start flag recorded in the RAM is set to OFF (S.103). When the LED of the power switch is not turned on (No in S.102), the AI mode first start flag recorded in the RAM is set to ON (S.104).

After the AI mode first start flag was set (S.103 or S.104), the microprocessor 20 performs a process of clearing a timer counter for the AI mode (S.105). The timer counter for the AI mode is a counter used to detect a time that passed after the control is started by the AI mode.

The microprocessor 20 determines whether the operation mode is set to the AI mode or not (S.106). To be more specific, the microprocessor 20 determines whether the operation mode is set to the AI mode or not, based on the ON/OFF information on the AI mode flag recorded in the RAM.

When the operation mode is not set to the AI mode (No in S.106), the microprocessor 20 records the ON pressure value and the OFF pressure value for each operation mode in the RAM, as fixed values (S.107). Depending on the set operation mode, the ON pressure value and the OFF pressure value in the motor unit 4 vary, and the pressure state maintained in the tank unit 2 vary. The microprocessor 20 uses the determined ON pressure value and the OFF pressure value as the fixed values, and performs the driving control of the motor unit 4.

When the operation mode is set to the AI mode (Yes in S.106), the microprocessor 20 determines whether 30 seconds have passed based on the timer counter (S.108). In detail, the microprocessor 20 determines whether a multiple of 30 seconds passed based on the timer counter. Therefore, when 30 seconds, 60 seconds, 90 seconds, . . . have passed after the process (S.105) of clearing the timer counter (more precisely, in first detection timing immediately after every 30 seconds have passed), it is determined that 30 seconds have passed based on the timer counter.

When it is determined that 30 seconds have passed based on the timer counter (Yes in S.108), the microprocessor 20 performs the process of lowering the ON pressure value and the OFF pressure value and the control current value of the AI mode, which are recorded in the RAM, by one stage (S.109). To be more specific, the microprocessor 20 lowers the ON pressure value and the OFF pressure value only by 0.1 MPa, and lowers the control current value only by 0.1 A. However, when the ON pressure value of the AI mode recorded in the RAM is already 2.5 MPa, the process of lowering the ON pressure value is not performed. When the OFF pressure value is 2.9 MPa, the process of lowering the OFF pressure value is not performed. Likewise, when the control current of the AI mode recorded in the RAM is 12.0 A, the process of lowering the control current value is not performed.

When a state where the operation mode is set to the AI mode (Yes in S.106) and a pressure value in the tank unit 2 that will be described below is more than the ON pressure value (No in S.112) is maintained for a lengthy time (a case where the process from S.106 to S.114 is repeatedly executed), a state where the motor unit 4 stops driving is maintained for a lengthy time. Thus, it may be determined that little compressed air is used. For example, this situation may be a situation where work is stopped or completed or a user is resting.

Therefore, unless the motor unit 4 is driven even when 30 seconds have passed after the timer counter of the AI mode is cleared, the driving amount of the motor unit 4 may be reduced by lowering the ON pressure value, the OFF pressure value, and the current control value by one stage. Further, it is possible to reduce power required for driving the motor unit 4 and to reduce a load applied to the tank unit 2, the motor unit 4 and the compressed air generating unit 3, according to the use condition.

After the process of S.107 or the process of S.109 was performed, or when the process of S.108 is No, the microprocessor 20 determines whether an error occurs or not, based on the presence of error information recorded in the RAM (S.110). Unless the error occurs (No in S110), the microprocessor 20 determines whether the LED of the power switch is turned on (S.111). When the LED of the power switch is turned on (Yes in S.111), the microprocessor 20 determines whether the pressure value in the tank unit 2 is equal to or less than the ON pressure value, based on the information on pressure value in the tank unit 2 recorded in the RAM (S.112).

When the error occurs (Yes in S110), the LED of the power switch is not turned on (No in S.111), or a pressure value in the tank unit 2 is not equal to or less than the ON pressure value (No in S.112), the microprocessor 20 determines whether a time passed by a multiple of 60 seconds, based on the timer counter (S.113). Further, when the time passed by the multiple of 60 seconds (Yes in S.113), the ON pressure value, the OFF pressure value and the control current value of the AI mode, recorded in the RAM, are recorded in the memory (non-volatile memory) (S.114). When the time has not passed by the multiple of 60 seconds (No in S.113), or when the ON pressure value, the OFF pressure value and the control current value are recorded in the memory (non-volatile memory) (S.114), the microprocessor 20 shifts the process to process (S.106) of determining whether the operation mode is set to the AI mode, and repeatedly executes the processes subsequent to the above-described process (S.106) again.

Meanwhile, when the pressure value in the tank unit 2 is equal to or less than the ON pressure value (Yes in S.112), the microprocessor 20 determines whether the AI mode first start flag recorded in the RAM is ON or not (S.115). When the AI mode first start flag is ON (Yes in S.115), the microprocessor 20 sets the initial values of the ON pressure value, the OFF pressure value and the control current value in the AI mode, recorded in the ROM, to the initial values of the respective values in the AI mode, and records them in the RAM (S.116). In detail, the ON pressure value is set to 3.0 MPa, the OFF pressure value is set to 3.4 MPa, and the control current value is set to 13.0 A.

When the AI mode first start flag is OFF (No in S.115), or the ON pressure value, the OFF pressure value and the control current value are set to the initial values (S.116), the microprocessor 20 performs the process of driving the motor unit 4 (S.117). Thereafter, the microprocessor 20 performs the process of clearing the timer counter for the AI mode (S.118), and sets the ON pressure value, the OFF pressure value and the control current value, based on the operation mode information recorded in the RAM (S.119).

In this regard, when the operation mode is the AI mode and the AI mode first start flag is ON (Yes in S.115), the ON pressure value, the OFF pressure value and the control current value in the AI mode are set by the initial values that are set in S.116. Further, when the operation mode is the AI mode and the AI mode first start flag is OFF (No in S.115), the ON pressure value, the OFF pressure value and the control current value that are reduced per 30 seconds in step S.109 are used.

The microprocessor 20 determines whether the operation mode is set to the AI mode, based on the ON/OFF information of the AI mode flag recorded in the RAM (S.120). When the operation mode is not set to the AI mode (No in S.120), the microprocessor 20 sets the ON pressure value and the OFF pressure value that are preset for each operation mode, as the fixed ON pressure value and OFF pressure value (S.121), and performs the driving of the motor unit 4.

When the operation mode is set to the AI mode (Yes in S.120), the microprocessor 20 determines whether one second passed or not, based on the timer counter (S.122). In detail, the microprocessor 20 determines whether time passed by a multiple of one second, based on the timer counter. Thus, when time of one second, two seconds, three seconds, . . . passed after the process (S.118) of clearing the timer counter (in more detail, every one second, and at an initial detection timing after each second), it is determined that one second passed based on the timer counter.

When one second passes (Yes in S.122), the microprocessor 20 determines whether the pressure value in the tank unit 2 is equal to or less than the driving pressure (Hereinafter, The driving pressure is referred to as a driving pressure value) of the driving tool, based on the information on the pressure value in the tank unit 2 recorded in the RAM (S.123). By way of example, 2.8 MPa may be used as this driving pressure value. When the pressure value in the tank unit 2 is equal to or less than the driving pressure value (Yes in S.123), the microprocessor 20 determines whether the pressure value in the tank unit 2 is equal to or less than the ON pressure value of the AI mode recorded in the RAM (S.124).

When the pressure value in the tank unit 2 is equal to or less than the ON pressure value of the AI mode (Yes in S.124), the microprocessor 20 performs a process of raising the control current value of the AI mode recorded in the RAM by one stage (S.125). To be more specific, the microprocessor 20 according to this embodiment performs the process of raising the control current value by 0.1 A. When the recorded control current value is 14.0 A, the microprocessor 20 does not perform the process of raising the control current value.

When the pressure value in the tank unit 2 is equal to or less than the driving pressure value and the pressure value in the tank unit 2 is equal to or less than the ON pressure value of the AI mode, it may be determined that the compressed air in the tank unit 2 does not follow the use condition of the air in the driving tool. Hence, in order to frequently determine a pressure condition in the tank unit 2 and to follow the use condition of the air, by a process (S.123) of determining whether the pressure value in the tank unit 2 is equal to or less than the driving pressure value and a process (S.124) of determining whether the pressure value in the tank unit is equal to or less than the ON pressure value every second (S.122), the control current value is rapidly increased in a short time (every second). By rapidly increasing the control current value in a short time (every second), it is possible to rapidly increase the driving ability of the motor unit 4, and to perform the process of advancing an increase in pressure of the compressed air.

When one second has not passed based on the timer counter (No in S.122), the pressure value in the tank unit 2 is not equal to or less than the driving pressure value (No in S.123), the pressure value in the tank unit 2 is not equal to or less than the ON pressure value recorded in the RAM (No in S.124), or the process is performed in S.125, the microprocessor 20 determines whether 10 seconds have passed based on the timer counter (S.126). In detail, the microprocessor 20 determines whether time passed by a multiple of 10 seconds, based on the timer counter. Therefore, when time passed by 10 seconds, 20 seconds and 30 seconds, . . . from the process (S.118) of clearing the timer counter (in more detail, every 10 seconds, and at an initial detection timing after 10 seconds), it is determined that 10 seconds have passed based on the timer counter.

When it is determined that 10 seconds have passed based on the timer counter (Yes in S.126), the microprocessor 20 determines whether the pressure value in the tank unit 2 is equal to or less than the driving pressure value, based on the information on the pressure value in the tank unit 2 recorded in the RAM (S.127). Further, when the pressure value in the tank unit 2 is equal to or less than the driving pressure value (Yes in S.127), the microprocessor 20 determines whether the pressure value in the tank unit 2 is equal to or less than the ON pressure value recorded in the RAM (S.128).

When the pressure value in the tank unit 2 is equal to or less than the ON pressure value recorded in the RAM (Yes in S.128), the microprocessor 20 performs a process of raising the ON pressure value of the AI mode recorded in the RAM only by 0.1 MPa, and simultaneously raising the OFF pressure value only by 0.1 MPa (S.129). However, the microprocessor 20 does not perform the process of raising the ON pressure value when the recorded ON pressure value is 3.6 MPa, and does not perform the process of raising the OFF pressure value when the recorded OFF pressure value is 4.0 MPa.

When the pressure value in the tank unit 2 is equal to or less than the driving pressure value (Yes in S.127), and a situation where the pressure value in the tank unit 2 is equal to or less than the ON pressure value (Yes in S.128) is continued for 10 seconds or more (Yes in S.126), it may be determined that the use amount of the air increases in the driving tool. Here, the driving pressure value that is the standard for determining the pressure value in the tank unit 2 is an example of a value that is determined based on the pressure value in the tank unit 2 required when the high pressure tool is used. Since the driving pressure value is changed by the used driving tool, the driving pressure value may be changed depending on the used tool.

Therefore, when the pressure value in the tank unit 2 is equal to or less than the driving pressure value, it may be determined that the pressure value in the tank unit 2 becomes too low, and the compressed air sufficient to use the driving tool is not stored in the tank unit 2, due to an increase in using amount of the air. Hence, when the pressure value in the tank unit 2 is equal to or less than the driving pressure value (Yes in S.127), and a situation where the pressure value in the tank unit 2 is equal to or less than the ON pressure value (Yes in S.128) is continued for 10 seconds or more (Yes in S.126), it is possible to increase the amount of compressed air that may be supplied to the tank unit 2 and to supply a relatively large amount of compressed air, by increasing both the ON pressure value and the OFF pressure value (S.129). Further, it is possible to increase the supply amount of the compressed air until the motor unit 4 is restarted (the pressure value in the tank unit 2 reaches the ON pressure value) after the tank unit 2 reaches the OFF pressure value and assumes a full state, by raising both the ON pressure value and the OFF pressure value, as such.

Further, when 10 seconds have not passed based on the timer counter (No in S.126), the pressure value in the tank unit 2 is not equal to or less than the driving pressure value (No in S.127), the pressure value in the tank unit 2 is not equal to or less than the ON pressure value of the AI mode recorded in the RAM (No in S.128), the process of S.129 is performed, or the process of S.121 is performed, the microprocessor 20 determines whether the error occurs, based on the presence of the error information recorded in the RAM (S.130).

When no error occurs (No in S130), the microprocessor 20 determines whether the LED of the power switch is turned on (S.131). When the LED of the power switch is turned on (Yes in S.131), the microprocessor 20 determines whether the pressure value in the tank unit 2 is equal to or more than the OFF pressure value, based on the information on the pressure value in the tank unit 2 recorded in the RAM (S.132). When the pressure value in the tank unit 2 is not equal to or more than the OFF pressure value (No in S.132), the microprocessor 20 shifts the process to process (S.120) of determining whether the operation mode is set to the AI mode, and repeatedly executes the processes subsequent to the above-described process (S.120) again.

When the error occurs (Yes in S130), the LED of the power switch is not turned on (No in S.131), or the pressure value in the tank unit 2 is equal to or more than the OFF pressure value (Yes in S.132), the microprocessor 20 sets the AI mode first start flag to an OFF state (S.133), and stops driving the motor unit 4 (S.134).

The microprocessor 20 records, in the memory (non-volatile memory), information on the power failure socket flag, information on the operation mode when the stop process is performed by the power switch, and information on the OFF pressure value, the ON pressure value and the control current value in the AI mode, according to the processing contents of S.130 to S.132 (S.135), shifts the process to process (S.105) of determining whether the operation mode is set to the AI mode, and repeatedly executes the processes subsequent to the above-described process (S.105) again.

Figure 8A:
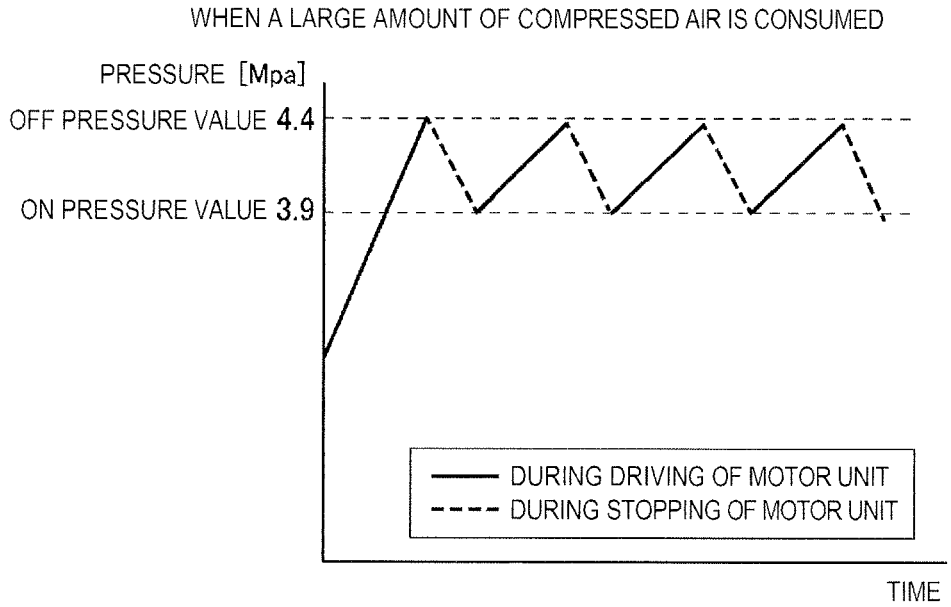
FIG. 8A is a diagram illustrating change in pressure state in a tank unit when an AI mode is not set in the air compressor according to the embodiment in a case that a large amount of compressed air is consumed.
Figure 8B:
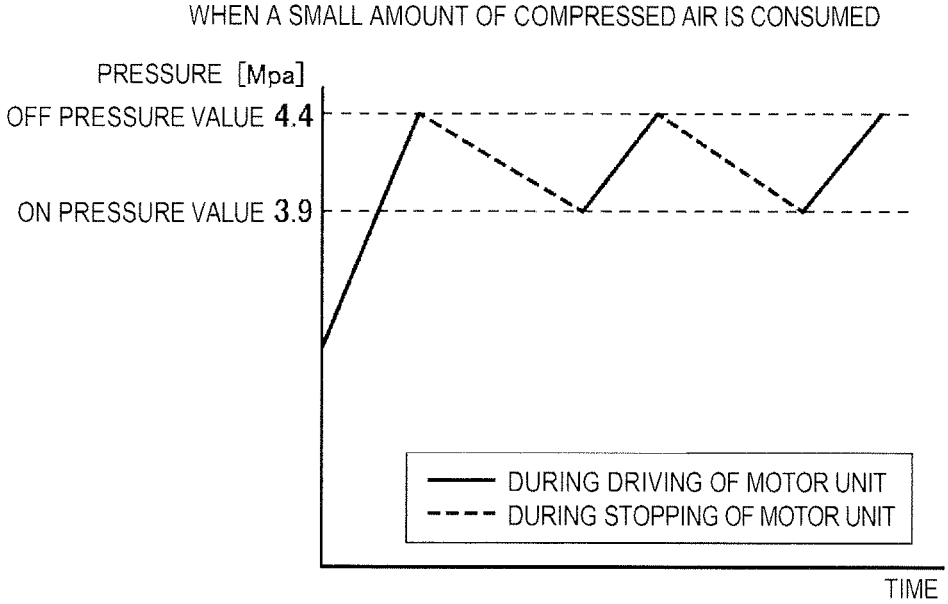
FIG. 8B is a diagram illustrating change in pressure state in a tank unit when an AI mode is not set in the air compressor according to the embodiment in a case that a small amount of compressed air is consumed.

FIGS. 8A and 8B are diagrams illustrating change in pressure value in the tank unit 2 when the operation mode is not set to the AI mode but is set to the power mode. When the operation mode is set to the power mode, the ON pressure value is fixed to 3.9 MPa and the OFF pressure value is fixed to 4.4 MPa. The change in pressure value in the tank unit 2 illustrated in FIG. 8A represents a case where a large amount of compressed air in the tank unit 2 is consumed, while the change in pressure value in the tank unit 2 illustrated in FIG. 8B represents a case where a small amount of compressed air in the tank unit 2 is consumed.

When the operation mode is not set to the AI mode, the pressure value in the tank unit 2 is maintained in the range from 3.9 MPa to 4.4 MPa, which is pressure between the ON pressure value and the OFF pressure value set to the power mode. Hence, even in the case where a large amount of compressed air in the tank unit 2 is consumed, as well as a case where a small amount of compressed air in the tank unit 2 is consumed, the pressure value in the tank unit 2 is maintained in the range from 3.9 MPa to 4.4 MPa, which is a high pressure value. Thus, an excessively high pressure load may be applied to the tank unit 2, the motor unit 4, the compressed air generating unit 3, and the like.

Figure 9A:
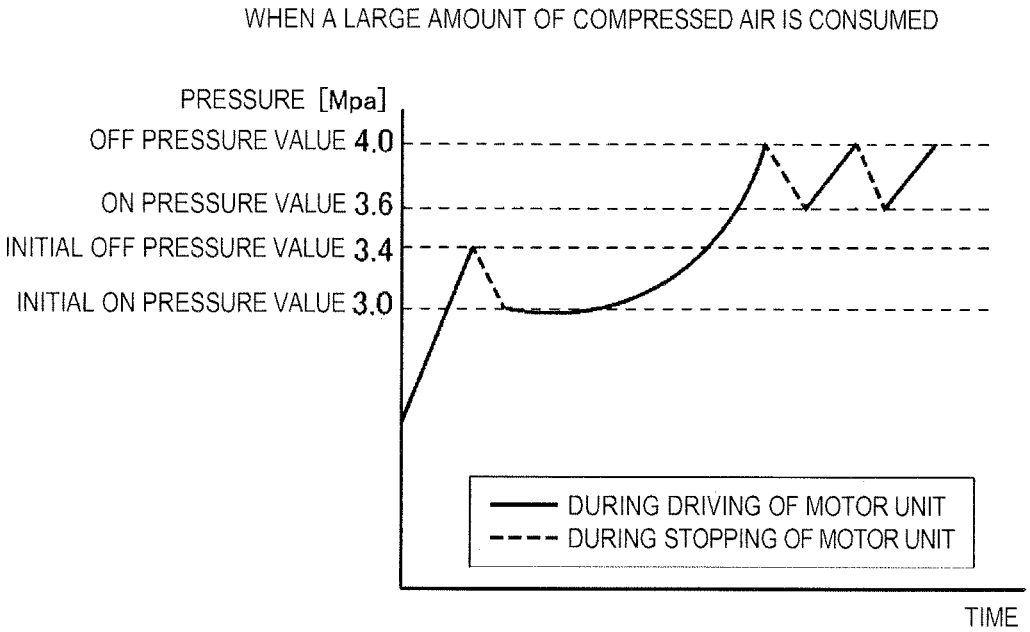
FIG. 9A is a diagram illustrating change in pressure state in the tank unit when the AI mode is set in the air compressor according to the embodiment in a case that a large amount of compressed air is consumed.
Figure 9B:
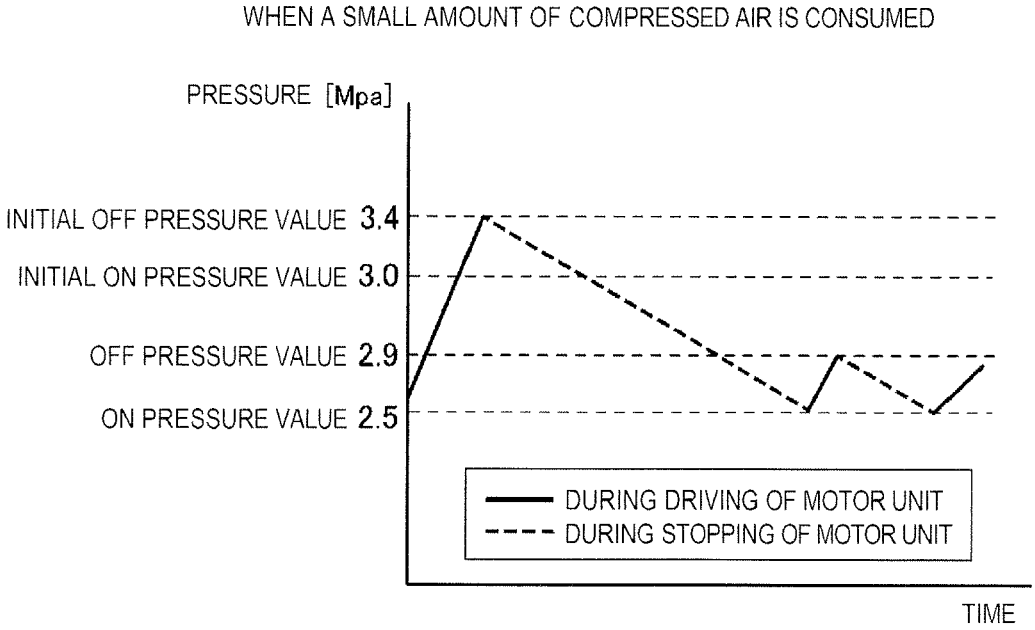
FIG. 9B is a diagram illustrating change in pressure state in the tank unit when the AI mode is set in the air compressor according to the embodiment in a case that a small amount of compressed air is consumed.

FIGS. 9A and 9B are diagrams illustrating change in pressure state in the tank unit when the operation mode is set to the AI mode. The change in pressure value in the tank unit 2 illustrated in FIG. 9A represents a case where a large amount of compressed air in the tank unit 2 is consumed, while the change in pressure value in the tank unit 2 illustrated in FIG. 9B represents a case where a small amount of compressed air in the tank unit 2 is consumed.

When the operation mode is set to the AI mode and a large amount of compressed air in the tank unit 2 is consumed, as illustrated in FIG. 9A, the control current value is increased and the driving force of the motor unit 4 is also increased. Thus, the compressed air may produce for a short time (the pressure value in the tank unit 2 is rapidly increased), and the ON pressure value and the OFF pressure value are increased (the ON pressure value and the OFF pressure value are changed to values that are higher than the ON pressure value and the OFF pressure value set as the initial values). Consequently, it is possible to more rapidly ensure a larger amount of compressed air.

Further, when the operation mode is set to the AI mode and a small amount of compressed air in the tank unit 2 is consumed, as illustrated in FIG. 9B, the control current value is decreased, and the ON pressure value and the OFF pressure value are also decreased (the ON pressure value and the OFF pressure value are changed to values that are lower than the ON pressure value and the OFF pressure value set as the initial values). Consequently, it is possible to keep a down time of the motor unit 4 long, in addition to preventing the interior of the tank unit 2 from being kept to an excessively high pressure value.

As such, since the down time of the motor unit 4 may be kept long and the operation thereof may be performed in a low pressure zone, it is possible to prevent an excessively high pressure load from being applied to the compressed air generating unit 3, the motor unit 4 and the tank unit 2. Further, since the down time of the motor unit 4 may be long and the compressing operation after the restarting operation may be performed in the low pressure zone, it is possible to improve silent performance in the air compressor 1. Further, since the control current value is reduced, the down time of the motor unit 4 is kept long, and the operation is performed in the low pressure zone, it is possible to achieve a reduction in power consumption of the motor unit 4.

Although the air compressor according to the invention is illustrated with reference to the air compressor 1 according to the embodiment, the air compressor according to the invention is not limited to the above-described embodiment. It is apparent to those skilled in the art that various changes or modifications realizing the same effects as the embodiment will be made without departing from the scope of claims.

For example, in the air compressor 1 according to the embodiment, the process (S.109) of lowering the ON pressure value, the OFF pressure value and the control current value by one stage is executed after determination every 30 seconds (S.108), the process (S.129) of raising the ON pressure value and the OFF pressure value by one stage is executed after determination every 10 seconds (S.126), and the process (S.125) of raising the control current value by one stage is executed after determination every 1 second (S.122). However, each determining time is not necessarily limited to the time illustrated in the embodiment. These times may be appropriately changed depending on the tank capacity of the tank unit 2, the kind of the driving tool that is mainly used or the like.

In the air compressor 1 according to the embodiment, the process of increasing or decreasing the ON pressure value and the OFF pressure value in the AI mode is performed by 0.1 MPa, but amounts of increasing or decreasing the ON pressure value and the OFF pressure value are not necessarily limited to 0.1 MPa. This value may be larger or smaller than 0.1 MPa.

The amount of increasing or decreasing the ON pressure value and the amount of increasing or decreasing the OFF pressure value are not necessarily limited to a configuration in which they are increased or reduced by the same value. For example, the amount of increasing or decreasing the ON pressure value and the amount of increasing or decreasing the OFF pressure value may be configured to be increased or reduced by different values. Further, the amount of increasing or decreasing the ON pressure value and the amount of increasing or decreasing the OFF pressure value may be configured to be increased or reduced by different pressure values in the case of raising or lowering the values.

For example, when the pressure value in the case of raising the value is set to be four times as large as the pressure value in the case of lowering the value, this may prevent the pressure control process in the tank unit 2 from being performed with the pressure value in the tank unit 2 sticking to an upper limit of the increased ON pressure value or a lower limit of the decreased OFF pressure value. In this case, at least the motor unit 4 or the like may be driven. Further, the amounts of increasing or decreasing the ON pressure value and the OFF pressure value may not be constant but may be changed depending on the pressure state in the tank unit 2 or the down time or operation time of the motor unit 4.

In order for the air compressor 1 according to the embodiment to determine the process of raising the ON pressure value, the OFF pressure value and the control current value by one stage, it is determined whether the pressure value in the tank unit 2 is equal to or less than the driving pressure value (S.123, S.127). As an example of the pressure value, 2.8 MPa may be employed. However, the invention is not necessarily limited to 2.8 MPa.

In the embodiment, it is assumed that the high pressure tool is employed as the driving tool connected to the air compressor 1, and, for example, 2.8 MPa is used to provide a sufficient amount of compressed air. However, values other than 2.8 MPa that is used by way of example may be utilized depending on the kind of the driving tool that is to be used or the using condition. For example, in the case of using only a low pressure tool, even a pressure value lower than 2.8

MPa satisfies a pressure value (driving pressure value) required to drive the driving unit. Thus, based on this pressure value, it is possible to determine the process of raising the ON pressure value, the OFF pressure value and the control current value by one stage.

The invention claimed is:

1. An air compressor comprising:

a tank that stores compressed air;

a motor that drives the air compressor to generates compressed air to be stored in the tank;

a pressure sensor that detects a pressure value in the tank; and a controller that drives the motor when a pressure value in the tank detected by the pressure sensor is equal to or less than a motor start pressure value, and stops the motor when the pressure value in the tank detected by the pressure sensor is equal to or greater than a motor stop pressure value, wherein, in a state where the motor is stopped, the controller reduces either the motor start pressure value or the motor stop pressure value each time a first predetermined time has passed, and wherein, in a state where i) the motor is started, ii) the pressure value in the tank detected by the pressure sensor is equal to or less than a predetermined value, and iii) the pressure value in the tank detected by the pressure sensor is equal to or less than the motor start pressure value, the controller increases either the motor start pressure value or the motor stop pressure each time a second predetermined time has passed.

2. The air compressor according to claim 1, wherein, in the state where the motor is stopped, the controller reduces a control current value for driving the motor each time the first predetermined time has passed, and wherein, in the state where i) the motor is started, ii) the pressure value in the tank detected by the pressure sensor is equal to or less than a predetermined value, and iii) the pressure value in the tank detected by the pressure sensor is equal to or less than the motor start pressure value, the controller increases the control current value each time a third predetermined time has passed.

3. The air compressor according to claim 2, wherein the second predetermined time is shorter than the first predetermined time, and wherein the third predetermined time is shorter than the second predetermined time.

4. The air compressor according to claim 2, wherein the predetermined value is a driving pressure value required to drive a tool connected to the air compressor.

5. The air compressor according to claim 1, wherein the predetermined value is a driving pressure value required to drive a tool connected to the air compressor.

6. An air compressor comprising: a tank that stores compressed air;

a motor that drives the air compressor to generates compressed air to be stored in the tank;

a pressure sensor that detects a pressure value in the tank; and a controller that drives the motor to generate compressed air that is stored in the tank when a pressure value in the tank detected by the pressure sensor is equal to or less than a predetermined motor start pressure value, and stops the motor when the pressure value in the tank detected by the pressure sensor is equal to or greater than a predetermined motor stop pressure value, wherein, in a state where the motor is stopped, the controller reduces either the motor start pressure value or the motor stop pressure value each time a first predetermined time has passed, and wherein, in a state where the motor is started and the pressure value in the tank detected by the pressure sensor is equal to or less than the predetermined motor start pressure value, the controller increases at least one of the predetermined motor start pressure value and the predetermined motor stop pressure value by a predetermined pressure value each time a second predetermined time has passed, wherein the first predetermined time is greater than the second predetermined time.

7. An air compressor comprising:

a tank that stores compressed air;

a motor that drives the air compressor to generates compressed air to be stored in the tank;

a pressure sensor that detects a pressure value in the tank; and a controller that drives the motor to generate compressed air that is stored in the tank when a pressure value in the tank detected by the pressure sensor is equal to or less than a predetermined motor start pressure value, and stops the motor when the pressure value in the tank detected by the pressure sensor is equal to or greater than a predetermined motor stop pressure value, wherein, in the state where the motor is stopped, the controller reduces a control current value for driving the motor each time a first predetermined time has passed, and wherein, in a state where the motor is started and the pressure value in the tank detected by the pressure sensor is equal to or less than the predetermined motor start pressure value, the controller increases the current control value by a predetermined amount each time a second predetermined time has passed, wherein the first predetermined time is greater than the second predetermined time.

* * * * *